United States Patent [19]
Yatsunami et al.
[11] 3,945,817
[45] Mar. 23, 1976

[54] METHOD FOR THE COLLECTION OF DUST OF A HIGH ZINC CONTENT DURING THE PRODUCTION OF REDUCED IRON PELLETS

[75] Inventors: Kazuharu Yatsunami; Satoru Miyakado; Katsuaki Shiohara, all of Fukuyama; Akira Honda, Yokohama, all of Japan

[73] Assignee: Nippon Kokan Kabushiki Kaisha, Tokyo, Japan

[22] Filed: Nov. 21, 1974

[21] Appl. No.: 525,953

[30] Foreign Application Priority Data

Dec. 17, 1973 Japan ..... 48-139693

[52] U.S. Cl. ..... 75/5; 75/3; 75/25
[51] Int. Cl.[2] ..... C22B 1/16; C22B 7/02
[58] Field of Search ..... 75/3, 5, 25, 86

[56] References Cited

UNITED STATES PATENTS

| | | | |
|---|---|---|---|
| 2,805,930 | 9/1957 | Udy | 75/3 |
| 3,188,201 | 6/1965 | Sontheimer | 75/25 |
| 3,224,871 | 12/1965 | Collin | 75/3 |
| 3,414,401 | 12/1968 | Fourt | 75/25 |
| 3,756,804 | 9/1973 | Stevenson | 75/25 |

*Primary Examiner*—Peter D. Rosenberg
*Attorney, Agent, or Firm*—Flynn & Frishauf

[57] ABSTRACT

In the production of reduced iron pellets from a material mainly comprising dust exhausted from metallurgical furnaces for iron and steel production, such as blast furnaces, converters, hearth furnaces and electric furnaces, and/or a mixture thereof, by means of a grate-kiln a furnace including a pretreatment furnace comprising, a drying zone, a preheating zone a hardening zone and travelling grate passing sequentially through said zones, and a rotary kiln receiving the output pellets from the hardening zone, hot exhaust gases from the rotary kiln are first passed through said hardening zone and then through said preheating zone to harden and preheat green pellets moving therein. Said exhaust gases are then introduced into a first dust collector, where dust of a high zinc content is almost completely collected from said exhaust gases. Said exhaust gases so purified are then passed through said drying zone to dry green pellets moving therein. Said exhaust gases are then introduced into a second dust collector, where dust is further collected from said exhaust gases before said exhaust gases are discharged out of a stack to open air. When the temperature of said exhaust gases which have passed said first dust collector is not high enough for a heat source for drying green pellets moving in said drying zone, the temperature of gases for drying is raised by blowing hot gases, which are separately produced by a fuel burner, into said drying zone. The dust of a high zinc content collected by said first dust collector is used as a material for zinc refining.

7 Claims, 2 Drawing Figures

METHOD FOR THE COLLECTION OF DUST OF A HIGH ZINC CONTENT DURING THE PRODUCTION OF REDUCED IRON PELLETS

FIELD OF THE INVENTION

This invention relates to a method for the collection of dust of a high zinc content available as a material for zinc refining in the production of reduced iron pellets by the grate-kiln system for firing.

BACKGROUND OF THE INVENTION

Since dust contained in exhaust gases from metallurgical furnaces for iron and steel production, such as blast furnaces, converters, hearth furances and electric furnaces, contains powdered iron oxide in large quantities, it is used as a burden material for blast furances, etc. However, such dust contains also zinc and/or zinc compounds in large quantities. Therefore, it is necessary to remove the zinc contained in said dust while reducing the iron oxide in said dust by firing said dust in the form of pellets in a reducing atmosphere, so that said dust may be used as a burden raw material for blast furnaces, etc.

As a process for satisfying this necessity, a method of producing reduced iron pellets is known which used what is called the grate-kiln system for firing. In this known method, green pellets produced from a material mainly comprising dust, such as blast furnace dust, converter dust, hearth furnace dust, electric furnace dust and/or a mixture thereof, are passed by means of a travelling grate 6' in the direction of arrows in FIG. 1 through a pretreatment furnace 2' comprising a drying zone 5', a preheating zone 4' and a hardening zone 3', where said pellets are dried, preheated and hardened in order, after which said pellets are charged into a rotary kiln and are fired to produce reduced iron pellets. In this process, zinc and/or zinc compounds contained in pellets are removed from said pellets through the high temperature in the rotary kiln and are entrained by the dust in exhaust gases from the rotary kiln. Therefore, the exhaust gases from the rotary kiln contain zinc in large quantities. In the conventional grate-kiln method for firing, hot exhaust gases of a high zinc content from the rotary kiln are used as a heat source for drying, preheating and hardening green pellets to be fired by being introduced into said pretreatment furnace 2'. More specifically, all or part of said hot exhaust gases from the rotary kiln is introduced through the passages shown by dotted lines into the hardening zone 3' of said pretreatment furnace 2' to harden green pellets moving therein, is then introduced through a cyclone 7' into the preheating zone 4' to preheat green pellets moving therein, and after that, is introduced through a cyclone 8' into the drying zone 5' to dry green pellets moving therein, and is finally introduced into a dust collector, such as an electrostatic dust precipitator and a bag filter, where dust in said exhaust gases is collected before said exhaust gases are discharged through a blower 10' out of a stack 13' to open air.

In the conventional method, as mentioned above, hot exhaust gases from the rotary kiln pass through said pretreatment furnace 2' in the order of said hardening zone 3', said preheating zone 4' and then said drying zone 5'. Accordingly, since the temperature of said exhaust gases introduced into said hardening zone 3' and said preheating zone 4' and of green pellets moving in these zones is relatively high, the zinc in said exhaust gases still remains therein. However, the temperature of said exhaust gases introduced into said drying zone 5' has fallen, and the temperature of green pellets moving therein is also low and in a wet condition, whereby part of zinc contained in said exhaust gases deposits on the surface of green pellets therein, resulting in contaminating the pellets with zinc and in reducing the zinc content of said exhaust gases as well. Since pellets so contaminated with zinc must be charged into the rotary kiln, the dezincification rate of the rotary kiln is reduced. Moreover, the zinc content of said exhaust gases is further reduced since said exhaust gases come to contain large quantities of powdered iron oxide produced by bursting of green pellets moving in said drying zone 5' while passing therethrough. Therefore, the zinc content of dust collected by a dust collector 9' is low, thereby making it industrially and economically impossible to use said collected dust as a material for practical zinc refining.

In consideration of the foregoing, though a method is needed for the collection of dust of a high zinc content available as a material for zinc refining in the production of reduced iron pellets by means of the grate-kiln system for firing, such method has not so far been proposed.

SUMMARY OF THE INVENTION

Therefore, the object of this invention is to provide an improved method of using hot exhaust gases from a rotary kiln in the production of reduced iron pellets from a material mainly comprising dust exhausted from metallurgical furnaces for iron and steel production, such as blast furnaces, converters, hearth furnaces and electric furnaces, and/or a mixture thereof, by means of the grate-kiln system for firing.

The principal object of this invention is to provide a method for the collection of dust of a high zinc content available as a material for zinc refining in the production of reduced iron pellets from a material mainly comprising dust exhausted from metallurgical furnaces for iron and steel production, such as blast furnaces, converters, hearth furnaces and electric furnaces, and/or a mixture thereof, by the grate-kiln system for firing.

In accordance with the present invention, in the production of reduced iron pellets from a material mainly comprising dust exhausted from metallurgical furnaces for iron and steel production, such as blast furnaces, converters, hearth furnaces and electric furnaces, and/or a mixture thereof, by means of a grate-kiln type furnace, said grate-kiln type furnace including a pretreatment furnace comprising a drying zone, a preheating zone following the drying zone, a hardening zone following the preheating zone and a travelling grate passing sequentially through the zones to carry green pellets therethrough, and a rotary kiln receiving the output material from said hardening zone, hot exhaust gases from said rotary kiln being first passed through said hardening zone and then through said preheating zone to harden and preheat the green pellets moving therein on said travelling grate. The exhaust gases from the preheating zone is then introduced into a first dust collector, such as an electrostatic dust precipitator and a bag filter, to collect dust of a high zinc content from said exhaust gases almost completely. Then the exhaust gases so purified from the first dust collector are passed through said drying zone to dry green pellets moving therein on said travelling grate, and the the from exhaust gases from said drying zone are fed to a second dust collector, such as an electrostatic dust precipitator and a bag filter, to collect further dust from the exhaust gases. The exhaust gases are then discharged from said second dust collector.

BRIEF DESCRIPTION

Of the drawings, FIG. 1 is a schematic drawing of the conventional method for the production of reduced iron pellets by the grate-kiln system for firing, and FIG. 2 is a schematic drawing of a method for the collection of dust of a high zinc content according to this invention in the production of reduced iron pellets by the grate-kiln system for firing.

DETAILED DESCRIPTION OF PREFERRED EMBODIMENTS

Figure 2:
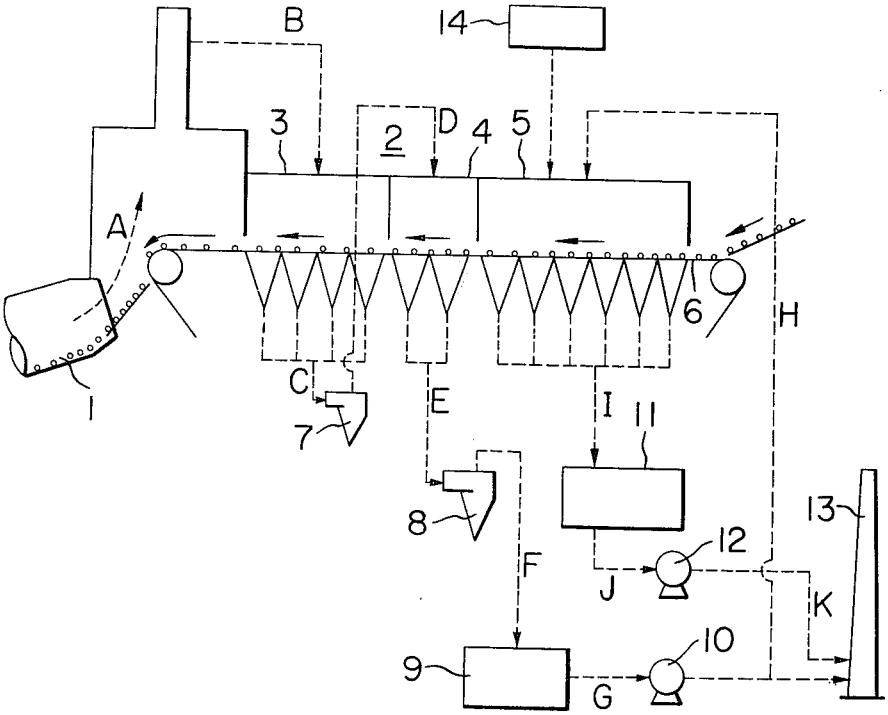

Referring to FIG. 2, the present invention is described in detail. Green pellets produced by a granulator (not illustrated) from a material mainly comprising dust collected from exhaust gases from metallurgical furnaces for iron and steel production, such as blast furnaces, converters, hearth furnaces and electric furnaces, and/or a mixture thereof, are fed onto a travelling grate 6 from the right side thereof as viewed in FIG. 2, said grate 6 passing through a pretreatment furnace 2 comprising a drying zone 5, a preheating zone 4 and a hardening zone 3. Said green pellets move successively by continuous movement of said grate 6 in the direction of the arrows through said drying zone 5, said preheating zone 4 and said hardening zone 3 of said pretreatment furnace 2, where said green pellets are dried, preheated and hardened in this order, and then, they are charged into a rotary kiln 1 arranged on the left of and close to said grate 6.

Hot exhaust gases produced in said rotary kiln 1 and used as a heat source for said pretreatment furnace 2 contain zinc in large quantities, as described above. Said hot exhaust gases are introduced from said rotary kiln 1 through passages A and B shown by dashed lines in FIG. 2 into said hardening zone 3 to harden green pellets moving therein and are introduced from the lower part of said zone 3 through a passage C into a cyclone 7, where part of the dust in said exhaust gases is collected. Said exhaust gases are then introduced through a passage D into said preheating zone 4 to preheat green pellets moving therein and are introduced from the lower part thereof through a passage E into a further cyclone 8, where part of the dust in said exhaust gases is further collected.

Figure 1:
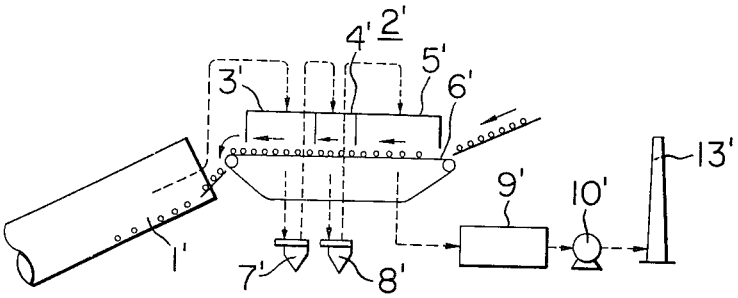

In the conventional grate-kiln system for firing, as is shown in FIG. 1, said exhaust gases which have passed through said preheating zone 4' and said cyclone 8', are then introduced into said drying zone 5' to dry green pellets moving therein, and are removed of their dust by said dust collector 9'. However, the temperature of said exhaust gases introduced into said drying zone 5' falls therein to a considerable extent, resulting in the above-mentioned disadvantages associated with the conventional method in such points that green pellets moving in said drying zone 5' are contaminated with zinc contained in said exhaust gases, that the dezincification rate of said rotary kiln 1' is reduced, and further that the zinc content of dust collected by said dust collector 9' is reduced.

Therefore, according to this invention as shown in FIG. 2, said exhaust gases which have passed said preheating zone 4 and a cyclone 8 are, prior to being introduced into said drying zone 5, introduced through a passage F into a first dust collector 9, such as an electrostatic dust precipitator and a bag filter, to collect zinc-containing dust from said exhaust gases almost completely. Such dust with a high electric resistance as zinc can be almost completely collected through regulation of the temperature and humidity in the first dust collector 9. Since the zinc content of dust collected by said first dust collector 9 in accordance with this invention exceeds 50% by weight, it is quite possible to use the dust so collected as a material for zinc refining industrially and economically. Since the temperature of said exhaust gases passing said cyclone 7 and 8 is still high, the dust collected therein scarcely contains zinc, resulting in its reuse as a material for green pellets without additional treatment.

Said exhaust gases almost completely removed of their zinc content in the above-mentioned manner are then introduced through a passage G, a blower 10 and a passage H into said drying zone 5 to dry green pellets moving therein. Since said exhaust gases passing through said drying zone 5, scarcely contain zinc, as mentioned above, green pellets moving therein will not be contaminated with zinc whereby the dezincification rate of said rotary kiln 1 will not be reduced.

Said exhaust gases which have passed through said drying zone 5 are introduced from the lower part thereof through a passage I into a second dust collector 11, such as an electrostatic dust precipitator and a bag filter, to collect dust further. Said exhaust gases are then discharged through a passage J, a blower 12 and a passage K out of a stack 13 to open air. Since the dust collected by said second dust collector 11 naturally contains zinc in the slightest quantity, it can be reused as a material for green pellets without additional treatment.

When the temperature of said exhaust gases which have passed through said first dust collector 9 is not sufficiently high to be a heat source for drying green pellets moving in said drying zone 5, part of said exhaust gases is discharged through said blower 10 out of said stack 13 to open air, and hot gases are separately produced by a fuel burner 14 and are blown into said drying zone 5 to raise the temperature of said gases for drying.

According to this invention as mentioned in detail above, in the production of reduced iron pellets from a material mainly comprising dust exhausted from metallurgical furnaces for iron and steel production, such as blast furnaces, converters, hearth furnaces and electric furnaces, and/or a mixture thereof, by the grate-kiln system for firing, hot exhaust gases of a high zinc content from said rotary kiln 1 are passed through said hardening zone 3 and said preheating zone 4 to harden and preheat green pellets moving therein, are then introduced into said first dust collector 9 to collect zinc-containing dust almost completely, and said exhaust gases so purified are introduced into said drying zone 5 to dry green pellets moving therein. Accordingly, the zinc content of dust collected by said first dust collector 9 exceeds 50% by weight enabling it to be used as a material for zinc refining industrially and economically. Moreover, the method in accordance with this invention makes a great contribution to the industry by providing such advantages that green pellets will not be contaminated with zinc contained in said exhaust gases and that the dezincification rate of said rotary kiln 1 will not be reduced.

What is claimed is:

1. A method for collecting dust of a high zinc content in the production of reduced iron pellets in at least one grate-kiln type furnace, said at least one furnace including a pretreatment furnace comprising a drying zone, a preheating zone following said drying zone, a hardening zone following said preheating zone and a travelling grate passing sequentially through said zones, and a rotary kiln receiving the output material from said hardening zone, the method comprising:

passing green pellets through said pretreatment furnace on said travelling grate and to said rotary kiln;

passing hot exhaust gases from said rotary kiln through said hardening zone and thereafter through said preheating zone to harden and preheat green pellets moving therein on said travelling grate;

then introducing the exhaust gases from said preheating zone into a first dust collector to collect dust of a high zinc content from the exhaust gases almost completely;

then passing the exhaust gases so purified from said first dust collector through said drying zone to dry green pellets moving therein on said travelling grate;

then introducing the exhaust gases from said drying zone into a second dust collector further dust from the exhaust gases; and then discharging said exhaust gases from said second dust collector.

2. A method according to claim 1, wherein said exhaust gases from said second dust collector are discharged to the atmosphere.

3. A method according to claim 1, wherein said exhaust gases are introduced to the respective zones in said pretreatment furnace at the upper portion of the respective zones, and are discharged from said respective zones from the lower portions thereof.

4. A method for collecting dust of a high zinc content in the production of reduced iron pellets in at least one grate-kiln type furnace, said at least one furnace including a pretreatment furnace comprising a drying zone, a preheating zone following said drying zone, a hardening zone following said preheating zone and a travelling grate passing sequentially through said zones, and a rotary kiln receiving the output material from said hardening zone, the method comprising:

passing green pellets through said pretreatment furnace on said travelling grate and to said rotary kiln;

passing hot exhaust gases from said rotary kiln through said hardening zone and thereafter through said preheating zone to harden and preheat green pellets moving therein on said travelling grate;

then introducing the exhaust gases from said preheating zone into a first dust collector to collect dust of a high zinc content from the exhaust gases almost completely;

discharging part of said exhaust gases so purified from said first dust collector and passing the remainder thereof through said drying zone to dry green pellets moving therein on said travelling grate;

blowing externally produced hot gases into said drying zone to raise the temperature of said drying exhaust gases in said drying zone;

then introducing a gas mixture of the remainder of said exhaust gases and said hot gases from said drying zone into a second dust collector further dust from the exhaust gases; and then discharging said gas mixture from said second dust collector.

5. A method according to claim 4, wherein said exhaust gases from said second dust collector are discharged to the atmosphere.

6. A method according to claim 4, wherein said exhaust gases are introduced to the respective zones in said pretreatment furnace at the upper portion of the respective zones, and are discharged from said respective zones from the lower portions thereof.

7. A method according to claim 4, wherein said externally produced hot gases are produced by a fuel burner.

* * * * *

UNITED STATES PATENT OFFICE

CERTIFICATE OF CORRECTION

PATENT NO. : 3,945,817

DATED : March 23, 1976

INVENTOR(S) : Kazuharu YATSUNAMI et al

It is certified that error appears in the above-identified patent and that said Letters Patent are hereby corrected as shown below:

Column 5, line 27 (Claim 1), after "dust collector" insert --to collect--;

Column 6, line 28 (Claim 4), after "dust collector" insert --to collect--.

Signed and Sealed this twenty-second Day of June 1976

[SEAL]

*Attest:*

RUTH C. MASON
*Attesting Officer*

C. MARSHALL DANN
*Commissioner of Patents and Trademarks*